US008863461B2

(12) United States Patent
Wagner et al.

(10) Patent No.: US 8,863,461 B2
(45) Date of Patent: Oct. 21, 2014

(54) SIDING PANEL SYSTEM

(71) Applicant: Tapco International Corporation, Wixom, MI (US)

(72) Inventors: Mark C. Wagner, Dryden, MI (US); Doug Williams, Middletown, OH (US); Daniel W. King, Copley, OH (US); Richard A. Wagner, Pinckney, MI (US); Matthew Jason Michalski, Sylvan Lake, MI (US); Jonathan Wierengo, Novi, MI (US); Daniel B. Franklin, Monroe, OH (US); Michael W. Maurer, Walled Lake, MI (US); Clyde G. Allen, Columbiaville, MI (US)

(73) Assignee: Tapco International Corporation, Wixom, MI (US)

( * ) Notice: Subject to any disclaimer, the term of this patent is extended or adjusted under 35 U.S.C. 154(b) by 0 days.

(21) Appl. No.: 13/746,137

(22) Filed: Jan. 21, 2013

(65) Prior Publication Data

US 2014/0202106 A1 Jul. 24, 2014

(51) Int. Cl.
*E04D 1/34* (2006.01)
*E04F 13/08* (2006.01)

(52) U.S. Cl.
CPC ..... *E04F 13/0801* (2013.01)
USPC ..... 52/545; 52/314; 52/520; 52/544; 52/547; 52/555

(58) Field of Classification Search
USPC ..... 52/314, 478, 520, 544–547, 555
See application file for complete search history.

(56) References Cited

U.S. PATENT DOCUMENTS

| | | | | |
|---|---|---|---|---|
| 3,593,479 | A | 7/1971 | Hinds et al. | |
| 3,862,532 | A * | 1/1975 | Markos | 52/521 |
| 4,001,997 | A * | 1/1977 | Saltzman | 52/521 |
| 4,343,126 | A | 8/1982 | Hoofe, III | |
| 4,468,903 | A * | 9/1984 | Eaton et al. | 52/105 |
| 4,598,522 | A | 7/1986 | Hoofe, III | |
| 4,932,184 | A * | 6/1990 | Waller | 52/535 |
| 5,455,099 | A | 10/1995 | Banner | |
| 6,526,718 | B2 | 3/2003 | Manning et al. | |
| 6,737,008 | B2 | 5/2004 | Gilbert et al. | |
| 2008/0185745 | A1 * | 8/2008 | Strout et al. | 264/35 |
| 2009/0020923 | A1 | 1/2009 | King | |
| 2011/0036037 | A1 * | 2/2011 | King | 52/520 |

* cited by examiner

*Primary Examiner* — Brian Glessner
*Assistant Examiner* — Brian D Mattei
(74) *Attorney, Agent, or Firm* — Quinn Law Group, PLLC

(57) ABSTRACT

A panel for attachment to a mounting surface includes a fastener edge defined along one edge of the panel and a butt edge defined opposite the fastener edge. The fastener edge contacts the mounting surface. The panel includes a plurality of raised faces formed between the fastener edge and the butt edge. The raised faces are oriented at a first angle to the mounting surface, such that the raised faces are further from the mounting surface toward the butt edge. The panel also includes a tapered keyway linking each of the raised faces. The tapered keyway extends from the raised faces toward the mounting surface and is at a second angle to the raised faces. An offset hem is formed on the fastener edge and extends away from the mounting surface.

8 Claims, 3 Drawing Sheets

SIDING PANEL SYSTEM

TECHNICAL FIELD

This disclosure relates siding panel systems for attachment to mounting surfaces.

BACKGROUND

Exterior siding systems often include a plurality of siding panels, with each of the siding panels formed to simulate a plurality of individual decorative units. For example, each siding panel may be formed to simulate multiple wooden shakes or shingles. As such, each decorative unit is formed to simulate a single shake or shingle. However, the decorative units may be formed to simulate other siding materials, including stone, tile, et cetera.

SUMMARY

A panel for attachment to a mounting surface is provided. The panel includes a fastener edge defined along one edge of the panel and a butt edge defined opposite the fastener edge. The fastener edge contacts the mounting surface.

The panel also includes a plurality of raised faces formed between the fastener edge and the butt edge. The raised faces are oriented at a first angle to the mounting surface, such that the raised faces are further from the mounting surface toward the butt edge.

The panel also includes a tapered keyway linking each of the raised faces. The tapered keyway extends from the raised faces toward the mounting surface and is at a second angle to the raised faces, such that the tapered keyway is not substantially parallel with the raised faces. An offset hem is formed on the fastener edge. The offset hem extends away from the mounting surface toward the tapered keyway of an adjacent panel.

The above features and advantages, and other features and advantages, of the present invention are readily apparent from the following detailed description of some of the best modes and other embodiments for carrying out the invention, which is defined solely by the appended claims, when taken in connection with the accompanying drawings.

DETAILED DESCRIPTION

Figure 1:
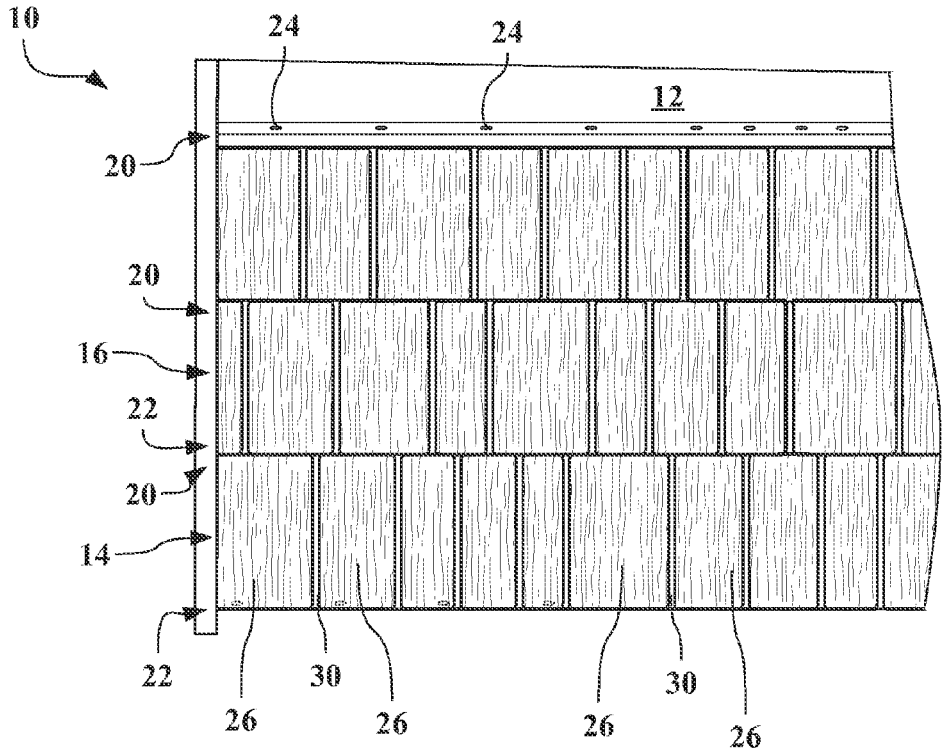
FIG. 1 is a schematic plan view of a siding system have a plurality of panels.

Referring to the drawings, like reference numbers correspond to like or similar components wherever possible throughout the several figures. There is shown in FIG. 1 a siding system 10 for attachment to a mounting surface 12. The siding system 10 includes at least a first panel 14 and a second panel 16. As shown, the siding system 10 actually includes a plurality of panels similar to the first panel 14 and the second panel 16. The mounting surface 12 shown is a vertical wall, but may be an angled wall or a roof surface.

While the present invention may be described with respect to specific applications or industries, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first" or "second" are illustrative only and are not intended to limit the scope of the invention in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

Figure 2:
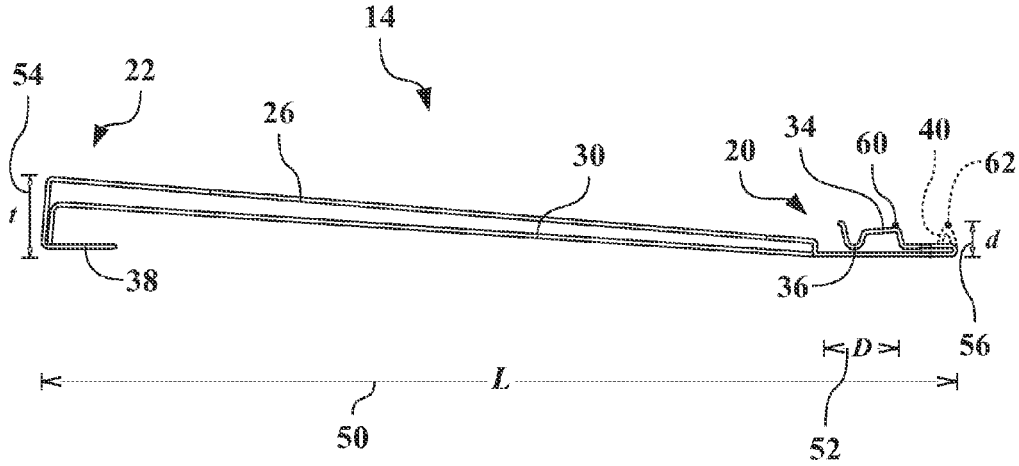
FIG. 2 is a schematic side view or planar section view of a first panel, which may be used in the siding system shown in FIG. 1.
Figure 3:
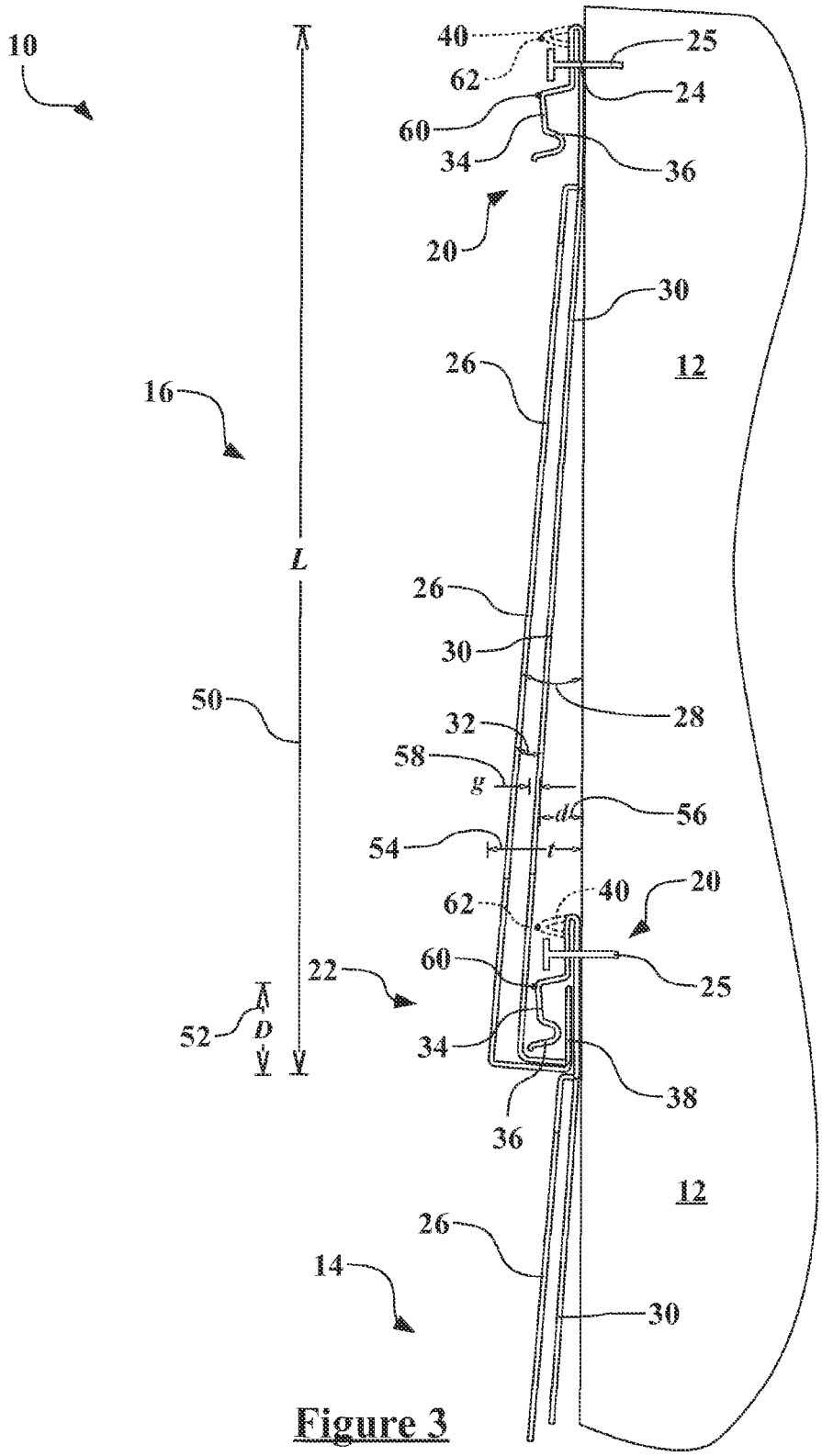
FIG. 3 is a schematic side view or planar section view of the first panel and a second panel of the siding system shown in FIG. 1 assembled onto the mounting surface.

Referring also to FIG. 2 and to FIG. 3, and with continued reference to FIG. 1, there are shown two schematic side views of portions of the siding system 10. FIG. 2 shows a side view of either the first panel 14 or the second panel 16. FIG. 3 shows a side view of the first panel 14 and the second panel 16 and illustrates the interface or mating between the mounting surface 12, the first panel 14, and the second panel 16. The views in FIG. 3 may be side views from the end on the panels or may be planer section views showing only the intersection of edges with the view plane.

Features of the first panel 14 and the second panel 16 will be described with reference to FIG. 1, FIG. 2, and FIG. 3. The second panel 16 generally has identical features to the first panel 14, such that the features of both will be described simultaneously. Note that manufacturing variance may lead to natural differences between panels.

The first panel 14 and the second panel 16 may be formed from different types of plastic or composite materials. For example, and without limitation, the first panel 14 and the second panel 16 may be formed from vinyl, polypropylene, et cetera. Furthermore, the first panel 14 and the second panel 16 may be formed as unitary, one-piece components, such that each of the first panel 14 and the second panel 16 is a single component formed from a single piece of material without subsequent attachment of pieces formed separately to complete each of the first panel 14 and the second panel 16.

As shown in the figures, the first panel 14 and the second panel 16 include a fastener edge 20 defined along one edge, which is shown as an upper edge in the FIGS. 1 and 3. A butt edge 22 is defined opposite the fastener edge 20, which is shown as a lower edge.

The fastener edge contacts the mounting surface 12 and has a plurality of fastener holes 24 defined there through. The fastener holes 24 are configured to mount the first panel 14 and the second panel 16 to the mounting surface 12 with a plurality of fasteners 25, which may include nails, screws, staples, et cetera. The fastener holes 24, fasteners 25, and mounting surface 12 are shown schematically in FIG. 3 to illustrate attachment. In some embodiments, the fastener holes 24 may not be fully defined through the fastener edge 22 but may instead be areas designated or identified for piercing by the fasteners 25, such that the fasteners at least partially pierce the material forming the first panel 14 and the second panel 16.

A plurality of raised faces 26 are formed between the fastener edge 20 and the butt edge 22. The raised faces 26 shown generally simulate wooden shingles, and have variable widths, as shown in FIG. 1. The raised faces 26 may be designed to represent other decorative units, including shakes, tiles, et cetera.

The raised faces 26 are oriented at a first angle 28 to the mounting surface 12. Therefore, the raised faces 26 are further from the mounting surface 12 toward the butt edge 22 than toward the fastener edge 20.

There is a tapered keyway 30 linking each of the raised faces 26. The tapered keyway 30 extends from the raised faces 26 toward the mounting surface 12, and may simulate the empty space between shingles. In the embodiment shown in the figures, the portion of the butt edge 22 at the tapered keyway 30 does not extend downward as far as the portion of the butt edge 22 at the raised faces 26.

The tapered keyways 30 are at a second angle 32 relative to the raised faces 26, and also have a different angle relative to the mounting surface. The second angle 32 differentiates the tapered keyways 30 shown from flat, non-tapered keyways, which are substantially parallel to the raised faces 26.

The tapered keyways 30 provide structural benefits relative to non-tapered keyways. The tapered keyways 30 are deeper at the butt edge 22 than flat keyways and have a larger wall between the tapered keyways 30 and the raised faces 26. The increased wall thickness of the tapered keyways 30 provides improved rigidity as the raised faces are pushed or flexed toward the mounting surface 12.

Note that the second panel 16 may have raised faces 26 of different size, number, or both, relative to the first panel 14. Such that the tapered keyways 30 need not be in the same location across the first panel 14 and the second panel 16, as shown in FIG. 1. Furthermore, even on panels intended to be identical, such as multiple copies of the first panel 14, manufacturing differences may exist.

An offset hem 34 is formed on the fastener edge 20 and extends away from the mounting surface 12. Although not generally needed to hold the first panel 14 to the mounting surface 12 with the fastener 25, the offset hem 34 creates depth or thickness from the mounting surface 12 at the fastener edge 20.

An overlap portion 36, or lock slot, is also formed on the fastener edge 20. The overlap portion 36 extends toward the butt edge 22, and may be formed as part of the offset hem 34 or may be extending from the offset hem 34.

As shown in FIG. 3, the butt edge 22 of the second panel 16 mates with the overlap portion 36 of the first panel 14. The butt edge 22 shown includes a lock tab 38, which may be the structure used to interface with the second panel 16 by sliding under part of the overlap portion 36.

The fastener edge 20 may include an additional or alternative offset hem 40, which may also act as a nailing hem to limit driving depth of the fasteners 25. The alternative offset hem 40 is shown with phantom lines in FIG. 3, but may be the primary offset, such that the offset hem 34 is not included in the first panel 14 or the second panel 16. The alternative offset hem 40 is on the opposing side of the fastener holes 24 from the overlap portion 36.

Typical assembly of the siding system 10 may include a bottom-up process. For example, the first panel 14 may be aligned on the mounting surface 12 and then attached by driving fasteners 25 through the fastener holes 24. Additional panels may then be placed to the right or left, as viewed in FIG. 1, of the first panel 14 and attached to the mounting surface 12, forming a first course of panels.

A second course of panels may then be placed on the mounting surface 12 above the first course. The second panel 16 is aligned above the first panel 14, as viewed in FIG. 1 and FIG. 3. The lock tab 40 of the second panel 16 is inserted into the overlap portion 36 of the first tab 14. The butt edge 22 of the second panel 16 is aligned to generally abut the top of the raised faces 26 of the first panel 14. This gives the appearance that the second panel 16 is formed from individual wood shingles laid partially over the top of wood shingles below, on the first panel 14.

In the siding system 10, a body length 50 is defined by the vertical distance (as viewed in FIG. 3) from the butt edge 22 to the fastener edge 20. The body length 50 is also illustrated in the figures by a dimension L. A deflection distance 52 is defined by the vertical distance from the butt edge 22 of the second panel 16 to the offset hem 34 of the first panel 14. The deflection distance 52 is illustrated in the figures by a dimension D.

In the siding system 10, a body thickness 54 is defined by the horizontal distance from the mounting surface 12 to the raised faces 26 at the butt edge 22. The body thickness 54 is illustrated in the figures by a dimension t. A deflection offset 56 is defined by the horizontal distance from the mounting surface 12 to the offset hem 34 or the alternative offset hem 40. The deflection offset 56 is illustrated in the figures by a dimension d.

A deflection gap 58 is defined by the horizontal distance from the offset hem 34 of the first panel 14 to the tapered keyway 30 of the second panel 16. The deflection gap is illustrated in the figures by a dimension g. However, the deflection gap 58 may also be defined by the horizontal distance from the alternative offset hem 40 to the tapered keyway 30, if that distance is smaller.

The deflection gap 58 is the space traveled, or the gap closed, when force is applied to the second panel 16. Therefore, a smaller deflection gap 58 means there is less flex in the second panel 16, and gives the siding system 10 improved rigidity.

The point of contact between the offset hem 34 and the tapered keyway 30 may be referred to as a deflection point 60. Similarly, the point of contact between the alternative offset hem 40 and the tapered keyway 30 is an alternative offset hem 40.

The ratio of the body length 50 to the deflection distance 52 (L/D) may be referred to as the deflection ratio. In some embodiments, the deflection ratio may be less than seven, which is the case with the alternative offset hem 40. However, with the offset hem 34, the deflection ratio is approximately ten.

The ratio of the body thickness 54 to the deflection gap 58 (t/g) may be referred to as the gap ratio. In some embodiments, the gap ratio may be at least five. Larger gap ratios mean that there is less distance through which the tapered keyway 30 flexes before contacting the deflection point 60 or the alternative deflection point 62 (on the offset hem 34 or the alternative offset hem 40, respectively).

Where the alternative offset hem 40 is formed into the first panel 14 and the second panel 16, the alternative deflection point 62 is above the fastener holes 24. In comparison to the deflection point 60 formed by the offset hem 34, the alternative deflection point 62 increases the deflection distance 52 and also reduces the deflection ratio by moving further upward and away from the butt edge 22.

Furthermore, the alternative deflection point 62 decreases the deflection gap 58 and increases the gap ratio by moving closer to the tapered keyway 30 on the adjacent panel. The gap ratio of the alternative deflection point 62 is larger than 6 in the configuration illustrated in FIGS. 1-3.

Figure 4:
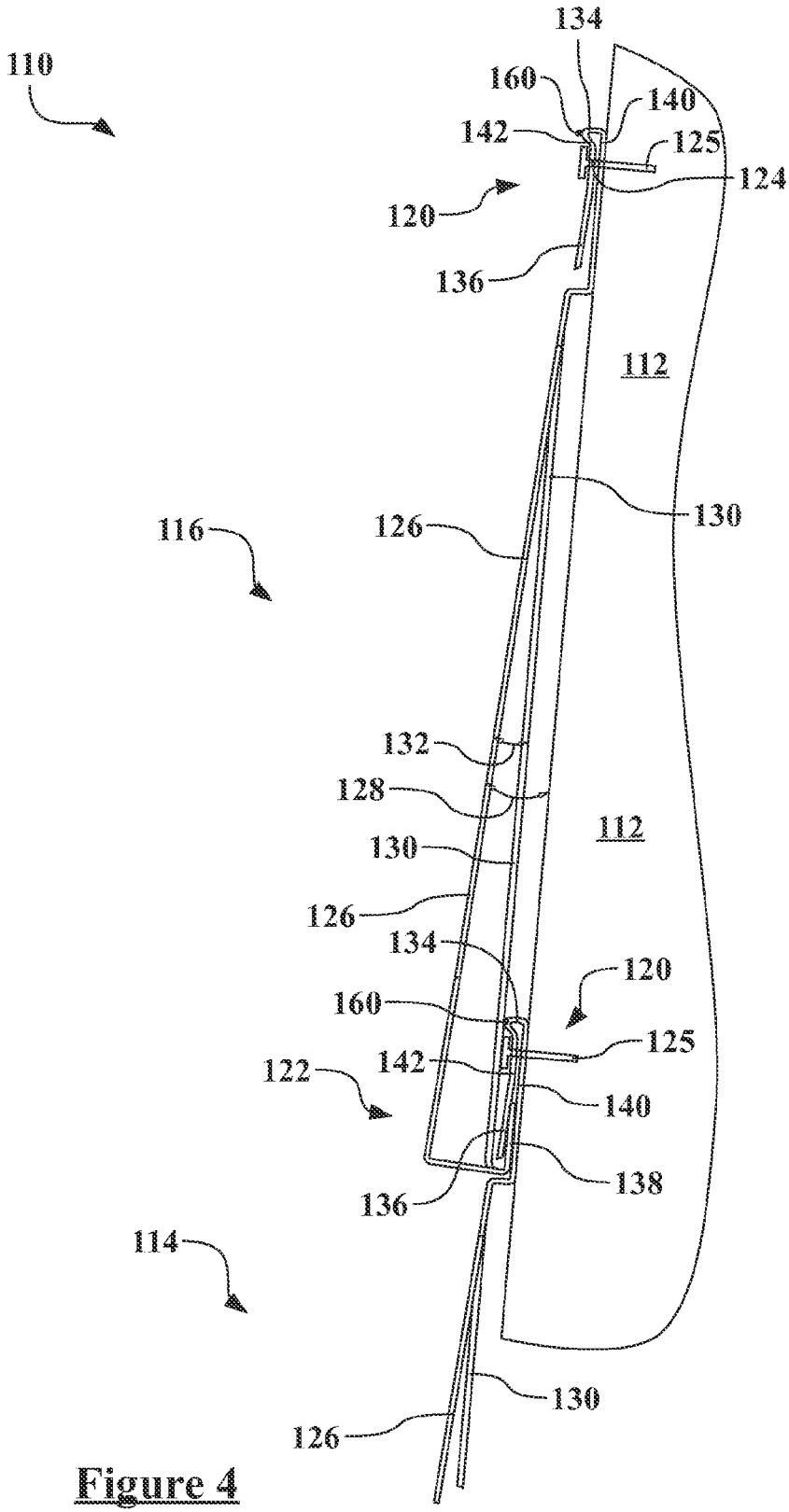
FIG. 4 is a schematic side view or planar section view of alterative panels that may be used with the siding system shown in FIG. 1.

Referring now to FIG. 4, and with continued reference to FIGS. 1-3, there is shown another siding panel system 110 attachable to a mounting surface 112. The siding system 110 is formed from a first panel 114 and a second panel 116. As in the siding system 10, the first panel 114 and the second panel 116 are substantially similar in profile. Features shown in FIG. 4 may be incorporated into the first panel 14 or the second panel 16 shown in FIG. 3, and vice versa.

The first panel 114 and the second panel 116 include a fastener edge 120 defined along one edge. A butt edge 122 is defined opposite the fastener edge 120, which is shown as a lower edge in the figures. The fastener edge 120 contacts the mounting surface 112 and has a plurality of fastener holes 124 defined there through. The fastener holes 124 are configured to mount the first panel 114 to the mounting surface 112 with a plurality of fasteners 125, which may include nails, screws, staples, et cetera. The fastener holes 124, fasteners 125, and mounting surface 112 are shown schematically in FIG. 4.

A plurality of raised faces 126 are formed between the fastener edge 120 and the butt edge 122. The raised faces 126 shown generally simulate wooden shingles, and have variable widths. The raised faces 126 may be designed to represent other decorative units, including shakes, tiles, et cetera. The raised faces 126 are oriented at a first angle 128 to the mounting surface 112. Therefore, the raised faces 126 are further from the mounting surface 112 toward the butt edge 122 than toward the fastener edge 120.

A tapered keyway 130 links each of the raised faces 126. The tapered keyway 130 extends from the raised faces 126 toward the mounting surface 112, and may simulate the empty space between shingles. As shown in FIG. 4, the tapered keyway 130 may not directly contact the mounting surface 112.

The tapered keyways 130 are at a second angle 132 relative to the raised faces 126. The second angle 132 between the tapered keyway 130 and the raised faces 126 differentiates the tapered keyways 130 shown from flat, non-tapered keyways, which are substantially parallel to the raised faces 126. In the siding system 110, the tapered keyway 130 is substantially parallel to the mounting surface 112.

An offset hem 134 is formed above the above fastener holes 124 on the first panel 114 and the second panel 116. The offset hem 134 creates depth or thickness from the mounting surface 112 at the fastener edge 120. The offset portion 134 further acts as a nailing flange, which may prevent over-driving the fastener 125 and causing portions of the fastener edge 120 to fracture. Preventing the fastener 125 from being driven too deeply toward the mounting surface 112 may also allow the first panel 114 and the second panel 116 to expand and contract slightly and better accommodate temperature changes.

An overlap portion 136, or lock slot, is also formed on the fastener edge 120. The overlap portion 136 extends toward the butt edge 122, and may be formed as part of the offset hem 134 or may be extending from the offset hem 134. The fastener edge 120 includes a folded portion, such that a back layer 140 is adjacent the mounting surface 112 and a front layer 142 is distal from the mounting surface 112. The offset hem 134 is formed in the front layer 142, and extends or protrudes away from the back layer 140 and then returns back toward the back layer 140 at, or near, the fastener holes 124. Therefore, the offset hem 134 creates or defines a significantly larger gap between the front layer 142 and the back layer 140 than exists at the fastener holes 124.

The butt edge 122 of the second panel 116 mates with the overlap portion 136 of the first panel 114. The butt edge 122 shown includes a lock tab 138, which may be the structure used to interface with the second panel 116 by sliding under part of the overlap portion 136.

The offset hem 134 improves the deflection response of the first panel 114 and the second panel 116 by increasing the deflection distance to a defection point 160. Additionally, the offset hem 134 is nearer to the tapered keyway 130, which limits the deflection gap between deflection point 160 and the tapered keyway 130, whether the tapered keyway 130 is as shown in FIG. 4 or is more similar to the tapered keyway 30 shown in FIG. 3.

In FIG. 4, the offset hem 134 is shown as contacting the tapered keyway 130. However, to account for manufacturing variations, most embodiments of the first panel 114 will be designed with at least a small distance, such that the deflection gap is greater than zero.

The detailed description and the drawings or figures are supportive and descriptive of the invention, but the scope of the invention is defined solely by the claims. While some of the best modes and other embodiments for carrying out the claimed invention have been described in detail, various alternative designs, configurations, and embodiments exist for practicing the invention defined in the appended claims.

The invention claimed is:

1. A panel for attachment to a mounting surface, comprising:

a fastener edge configured to contact the mounting surface;

a butt edge defined opposite the fastener edge;

a plurality of raised faces formed between the fastener edge and the butt edge, wherein the raised faces are oriented at a first angle to the mounting surface, such that the raised faces are further from the mounting surface toward the butt edge than toward the fastener edge;

a tapered keyway linking each of the raised faces, wherein the tapered keyway extends from the raised faces toward the mounting surface and is at a second angle to the raised faces;

an overlap portion formed on the fastener edge from a folded layer of the panel and defining a back layer adjacent the mounting surface and a front layer distal from the mounting surface, wherein a lock slot is defined between the front layer and the back layer;

an offset hem formed on the front layer of the fastener edge, wherein the front layer protrudes away the back layer and the mounting surface, and then returns toward the back layer;

a plurality of fastener holes defined through the fastener edge, wherein the fastener holes pass through the front layer and the back layer and are configured to mount the first panel to the mounting surface with a plurality of fasteners; and wherein the offset hem is formed above the fastener holes, relative to gravity as configured to be attached to the mounting surface, such that a deflection point is defined above the fastener holes.

2. The panel of claim 1, wherein the tapered keyway does not contact the mounting surface.

3. A siding system for attachment to a mounting surface, comprising:

a first panel having:

a fastener edge configured to contact the mounting surface;

a butt edge defined opposite the fastener edge;

a plurality of raised faces formed between the fastener edge and the butt edge, wherein the raised faces are oriented at a first angle to the mounting surface, such that the raised faces are further from the mounting surface toward the butt edge than toward the fastener edge;

a tapered keyway linking each of the raised faces, wherein the tapered keyway extends from the raised faces toward the mounting surface and is at a second angle to the raised faces;

an overlap portion formed from a folded layer of the panel and defining a back layer adjacent the mounting surface and a front layer distal from the mounting surface;

an offset hem formed on the front layer of the fastener edge, wherein the front layer protrudes away the back layer and the mounting surface, and then returns toward the back layer; and a lock slot defined by the overlap portion, wherein the offset hem defines a greater gap than the lock slot; and a second panel having;

a fastener edge configured to contact the mounting surface;

a butt edge defined opposite the fastener edge;

a plurality of raised faces formed between the fastener edge and the butt edge, wherein the raised faces are oriented at a first angle to the mounting surface, such that the raised faces are further from the mounting surface toward the butt edge than toward the fastener edge;

a tapered keyway linking each of the raised faces, wherein the tapered keyway extends from the raised faces toward the mounting surface and is at a second angle to the raised faces;

an overlap portion formed from a folded layer of the panel and defining a back layer adjacent the mounting surface and a front layer distal from the mounting surface;

an offset hem formed on the front layer of the fastener edge, wherein the front layer protrudes away the back layer and the mounting surface, and then returns toward the back layer;

a plurality of fastener holes defined through the fastener edge, wherein the offset hem is formed above the fastener holes, relative to gravity as configured to be attached to the mounting surface, such that a deflection point is defined above the fastener holes; and a lock slot defined by the overlap portion, wherein the offset hem defines a greater gap than the lock slot;

wherein the butt edge of the second panel mates with the overlap portion of the first panel.

4. The siding system of claim 3, further comprising:

a body length defined by the vertical distance from the butt edge to the fastener edge;

a deflection distance defined by the vertical distance from the butt edge of the second panel to the offset hem of the first panel; and wherein the ratio of the body length to the deflection distance is less than ten.

5. The siding system of claim 4, further comprising:

a body thickness defined by the horizontal distance from the mounting surface to the raised faces at the butt edge;

a deflection gap defined by the horizontal distance from the offset hem of the first panel to the tapered keyway of the second panel; and wherein the ratio of the body thickness to the deflection gap is at least five.

6. The siding system of claim 5, wherein the tapered keyway is substantially parallel to the mounting surface.

7. The siding system of claim 3, further comprising:

a body thickness defined by the horizontal distance from the mounting surface to the raised faces at the butt edge;

a deflection gap defined by the horizontal distance from the offset hem of the first panel to the tapered keyway of the second panel; and wherein the ratio of the body thickness to the deflection gap is at least five.

8. The siding system of claim 7, further comprising:

a body length defined by the vertical distance from the butt edge to the fastener edge;

a deflection distance defined by the vertical distance from the butt edge of the second panel to the offset hem of the first panel; and wherein the ratio of the body length to the deflection distance is less than ten.

* * * * *